US007534197B1

(12) United States Patent
Harbers, Jr.

(10) Patent No.: US 7,534,197 B1
(45) Date of Patent: May 19, 2009

(54) STRUCTURAL MODE DOOR SUPPORT OF EXERCISE EQUIPMENT

(75) Inventor: Henry C. Harbers, Jr., Templeton, CA (US)

(73) Assignee: Atoll Holdings Inc., San Luis Obispo, CA (US)

( * ) Notice: Subject to any disclaimer, the term of this patent is extended or adjusted under 35 U.S.C. 154(b) by 4 days.

(21) Appl. No.: 11/810,636

(22) Filed: Jun. 7, 2007

(51) Int. Cl.
*A63B 1/00* (2006.01)

(52) U.S. Cl. ..... 482/40; 482/904

(58) Field of Classification Search ..... 482/38–40, 482/904; 269/6, 236, 905; 248/214, 229.17, 248/228.8, 230.8, 231.17, 228.6, 229.15
See application file for complete search history.

(56) References Cited

U.S. PATENT DOCUMENTS

| | | | | | |
|---|---|---|---|---|---|
| 450,187 | A | | 4/1891 | Peterson | |
| 798,376 | A | * | 8/1905 | Whitman | 269/98 |
| 1,055,937 | A | * | 3/1913 | Mitchell | 269/37 |
| 1,511,704 | A | * | 10/1924 | Buck | 24/326 |
| 2,774,622 | A | * | 12/1956 | Priebe | 292/288 |
| 3,156,465 | A | | 11/1964 | Jacobi | |
| 3,381,958 | A | | 5/1968 | Gulland | |
| D212,021 | S | | 8/1968 | Gregory | |
| 3,430,953 | A | * | 3/1969 | Teetor | 482/40 |
| 3,506,261 | A | | 4/1970 | Gregory | |
| 3,606,315 | A | | 9/1971 | Green | |
| 3,782,718 | A | | 1/1974 | Saylor | |
| 3,995,714 | A | | 12/1976 | Brookes et al. | |
| 4,161,998 | A | | 7/1979 | Trimble | |
| 4,225,130 | A | * | 9/1980 | Zimmerman | 482/60 |
| 4,834,352 | A | * | 5/1989 | Thornton | 269/6 |
| 5,000,441 | A | | 3/1991 | Wang | |
| 5,098,089 | A | | 3/1992 | Harrington et al. | |
| 5,201,694 | A | * | 4/1993 | Zappel | 482/133 |
| 5,288,283 | A | * | 2/1994 | Meeker | 482/69 |
| 5,381,989 | A | * | 1/1995 | Jackson | 248/231.51 |
| 5,429,571 | A | * | 7/1995 | Smith et al. | 482/115 |
| 5,679,100 | A | | 10/1997 | Charnitski | |
| 5,720,702 | A | * | 2/1998 | Lee | 482/129 |
| 5,765,820 | A | * | 6/1998 | Marusiak | 269/6 |
| 5,800,323 | A | * | 9/1998 | Ansel | 482/129 |
| 6,076,634 | A | | 6/2000 | Simon | |
| 6,240,815 | B1 | * | 6/2001 | Huang | 81/328 |
| 6,244,994 | B1 | | 6/2001 | Tilberis | |
| 2003/0204961 | A1 | * | 11/2003 | Sumner | 33/194 |
| 2007/0020071 | A1 | * | 1/2007 | Williams | 414/455 |
| 2008/0070754 | A1 | * | 3/2008 | Gonzalez Monroy | 482/38 |

* cited by examiner

*Primary Examiner*—Loan H Thanh
*Assistant Examiner*—Allana Lewin
(74) *Attorney, Agent, or Firm*—William W. Haefliger

(57) ABSTRACT

The method of human body suspension, that includes providing an upright door, and a support body clamped to the door; straddling the door by extending human legs generally transversely at opposite sides of the door; providing grips operatively connected to the support body to project outwardly at opposite sides of the door, and manually grasping the grips to exert force acting to suspend the human torso and legs which remain straddling the door and extending transversely during suspending of the torso and legs.

27 Claims, 6 Drawing Sheets

STRUCTURAL MODE DOOR SUPPORT OF EXERCISE EQUIPMENT

BACKGROUND OF THE INVENTION

This invention relates generally to exercise apparatus and methods, and more particularly to apparatus enabling human body lifting or suspension, as well as methods of use of such apparatus.

There is need for an improved, simple, effective and easily used device enabling arm lifting of the body, in various modes, while the user's legs remain in a straddling position.

Also needed is an improved lightweight device as referred to constructed to facilitate transport, in a collapsed state, and quick set up at a destination, and to further facilitate ease of installation, for use, as described.

SUMMARY OF THE INVENTION

It is a major object of the invention to provide improved apparatus, and methods of use thereof, meeting the above needs. Basically, the invention in its apparatus aspects includes:

a) a support body associated with a clamp and configured for clamping to an upright door, b) grips operatively connected to the body to project outwardly at opposite sides of a plane defined by the door, to be manually grasped to receive lifting force exertion acting to suspend the human torso while the human legs remain straddling the door during said suspending of the torso and legs.

Another object includes provision of a method of human body suspension, which includes a) providing an upright door, and a support body clamped to the door, b) straddling the door by extending human legs generally transversely at opposite sides of the door, c) providing grips operatively connected to the support body to project outwardly at opposite sides of the door, d) and manually grasping the grips to exert force acting to suspend the human torso and legs which remain straddling the door and extending transversely during said suspending of the torso and legs.

That method may also include lowering the human torso and legs, and then repeating said elevating and lowering, to strengthen muscles of the human arms, torso and legs.

Another object is to provide a door clamp pivotally carried by the body, one of the grips operatively connected to the clamp to pivot the clamp thereby to progressively press connect to the door as said one grip is manually pulled downwardly relative to the body and door.

An added object is to provide clamp angled surfaces variably presented toward the door as the clamp is rotated by a grip. The clamp may typically have an axis of rotation, provided by a spring urged pivot, that is shifted first away from the door and then toward the door as the clamp is rotated downwardly to move one of said angles surfaces away from the door and to move the other of said surfaces toward the door to exert door clamping force. The angled surfaces typically include over center clamping surfaces associated with one of the grips, and configured to successively transmit clamping force to the door during said downward pivoting of the one grip, and wherein maximum clamping force is transmitted to the door in downward most pivoted position of said one grip.

An additional object is to provide a latch shiftable into and out of a position wherein the clamp is held in a down position in which said clamp other surface exerts door clamping force.

Another object is to provide door protective material on the clamp to slidably engage the door and press connect thereto.

Another object is to provide a crotch protector attached to the door, below the level of said support body.

Also, an elongated safety ribbon may be attached to the support body and extended over the top of the door.

A further object is to provide a method that includes elevating the torso while the legs remain transversely extended, as in L-shaped configuration. A timer on the body is usable to time the duration of leg and torso holding or suspension periods.

These and other objects and advantages of the invention, as well as the details of an illustrative embodiment, will be more fully understood from the following specification and drawings, in which:

DRAWING DESCRIPTION

Figure 2:
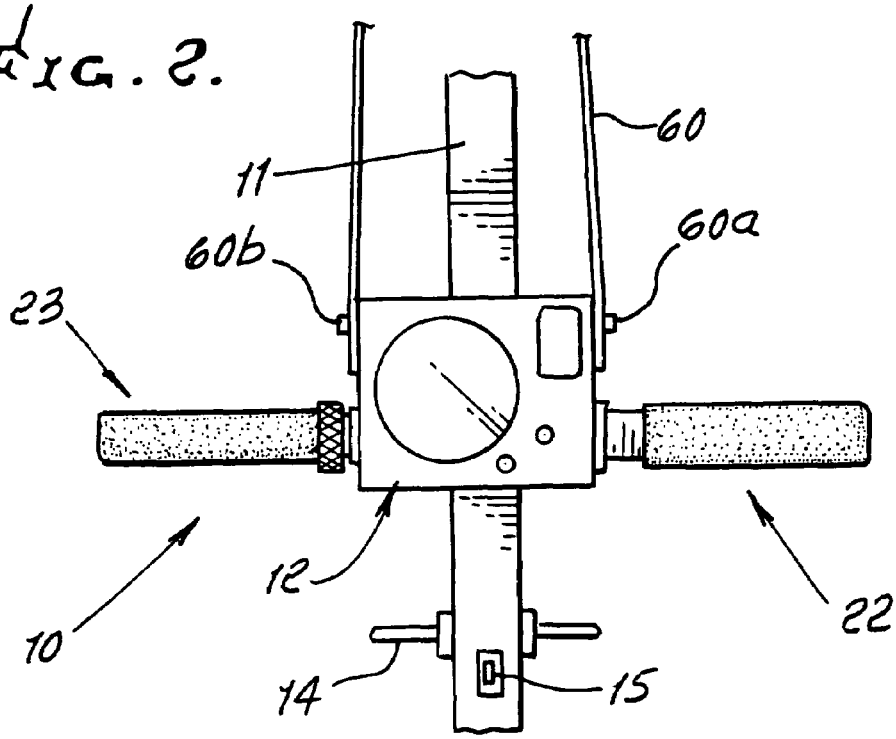
FIG. 2 shows the FIG. 1 apparatus being clamped to a door.
Figure 3:
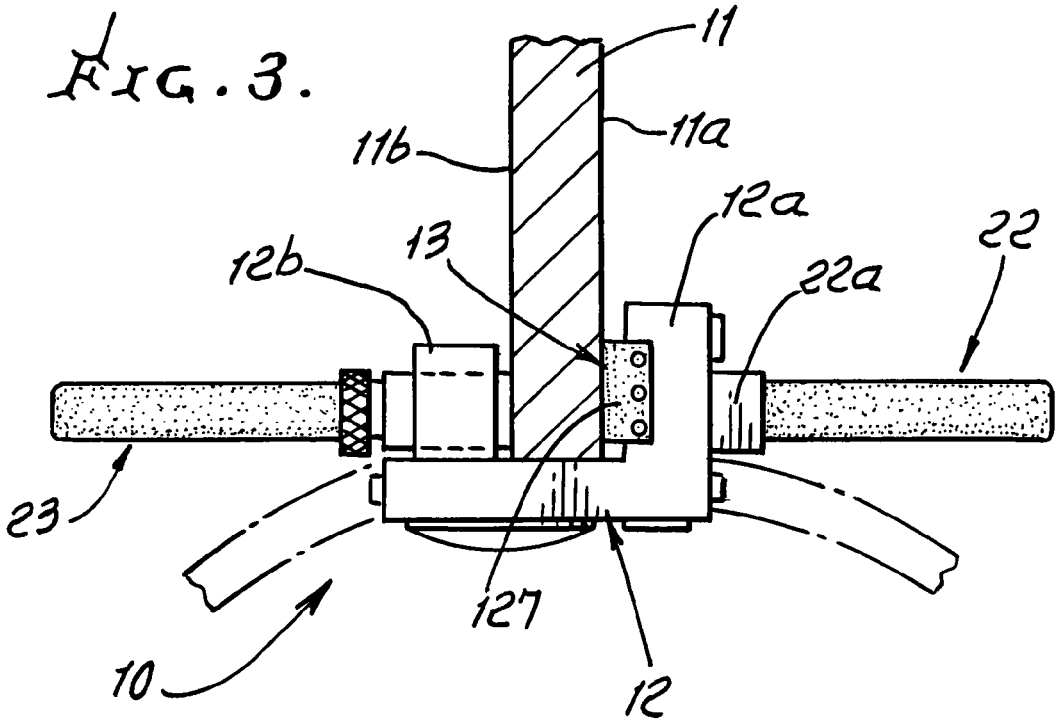
FIG. 3 is a top plan view of the FIG. 1 apparatus.
Figure 3A:
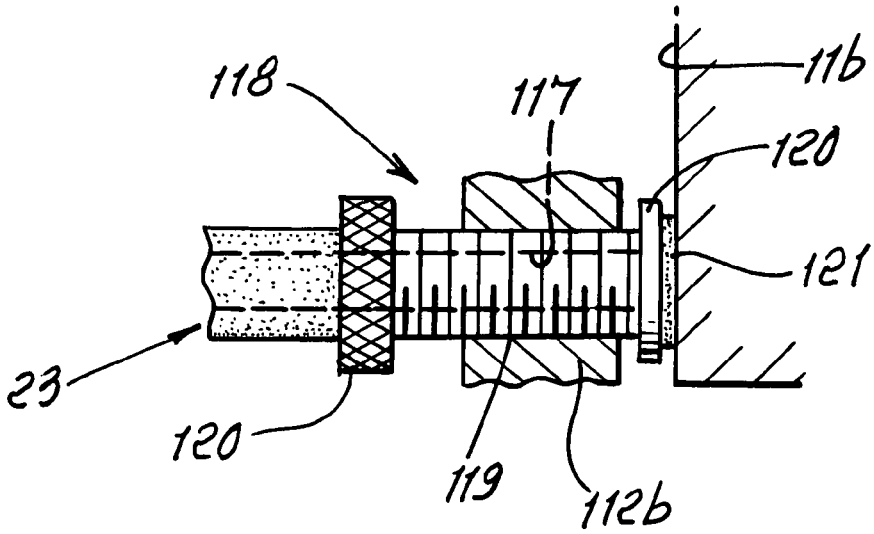
Figure 5:
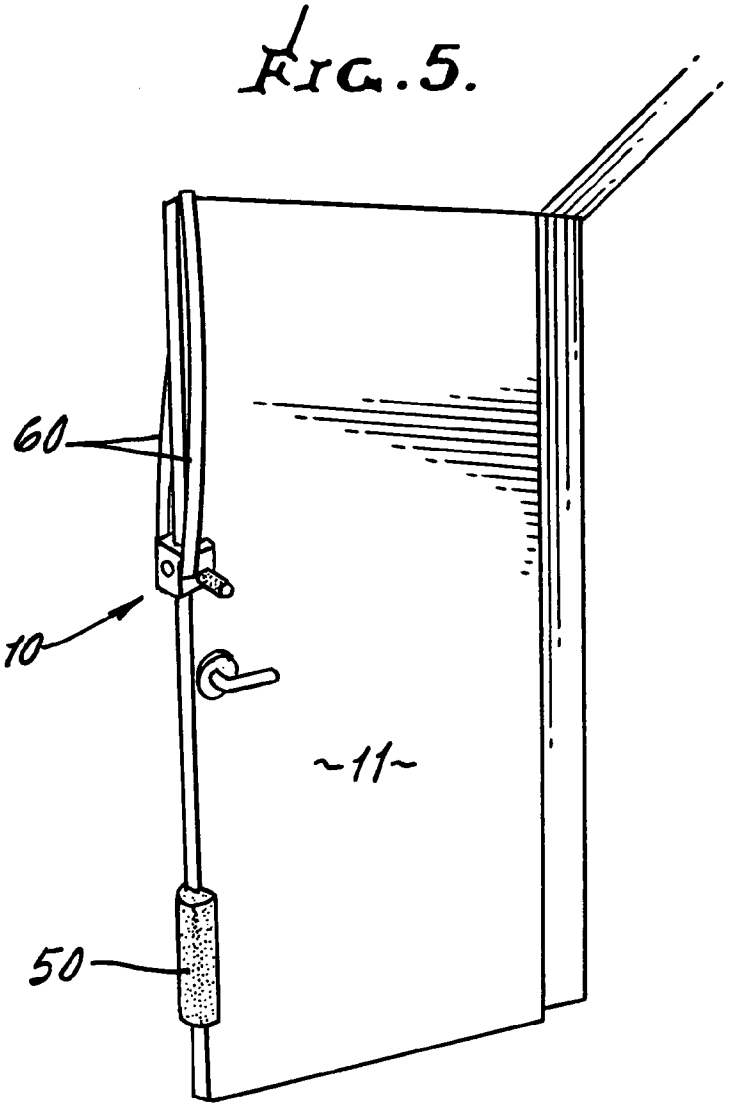
Figure 4:
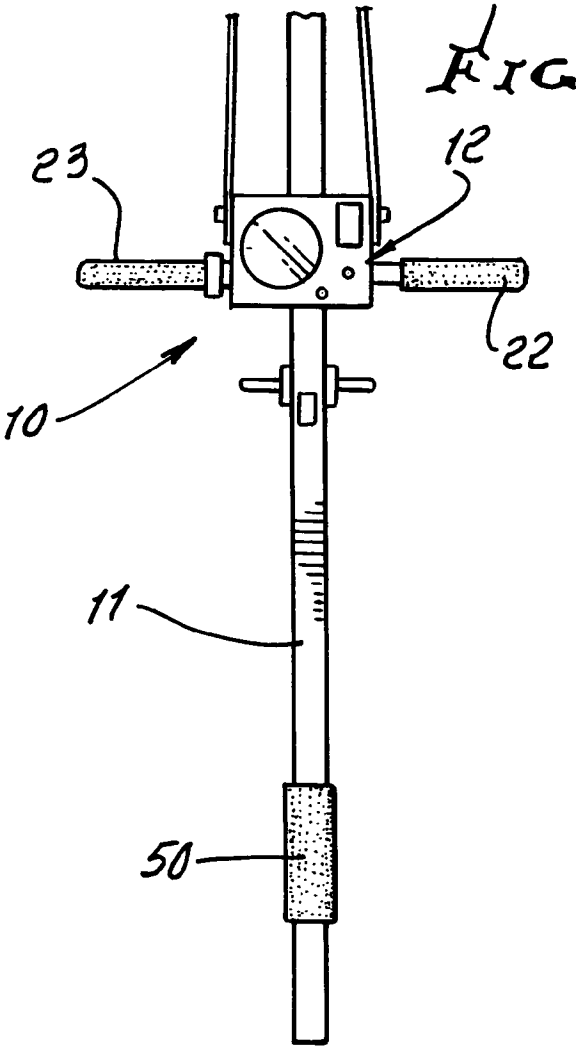
Figure 7:
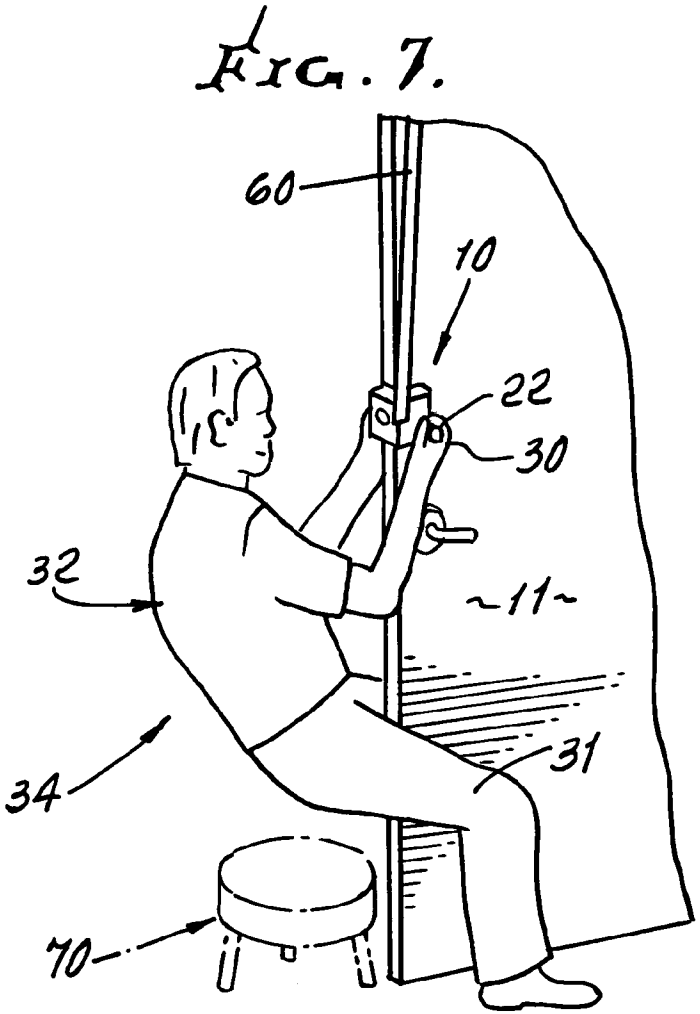
Figure 6:
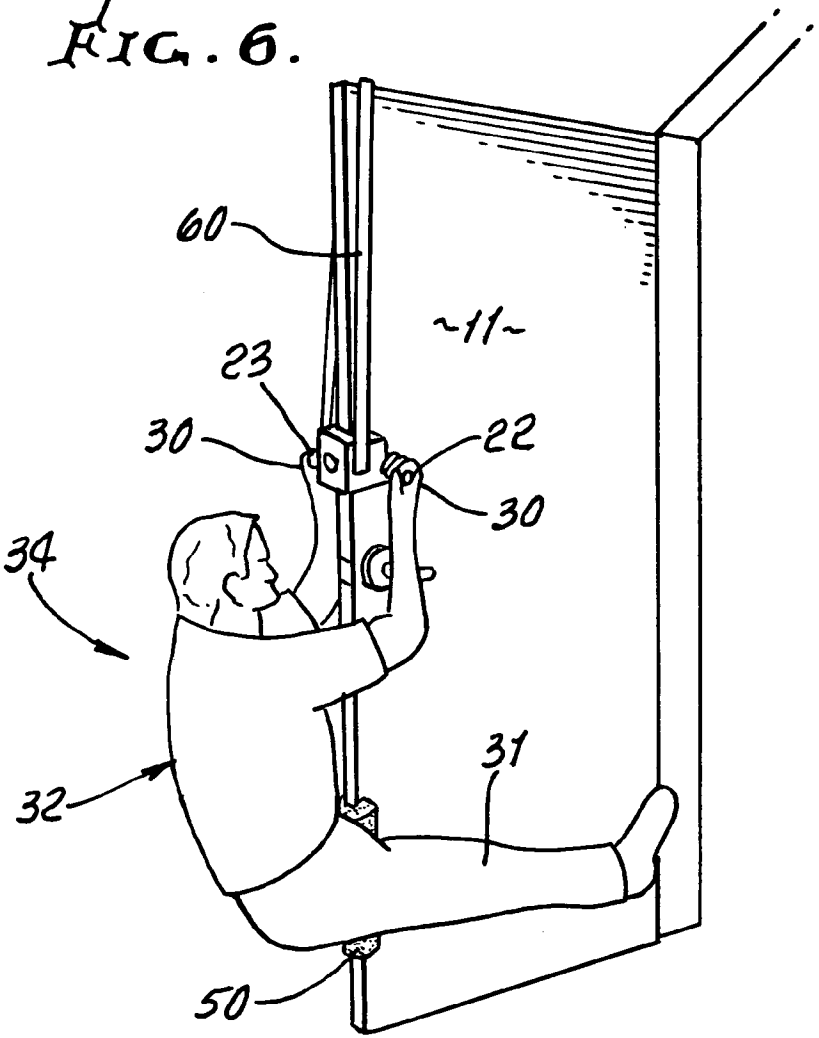
Figure 8:
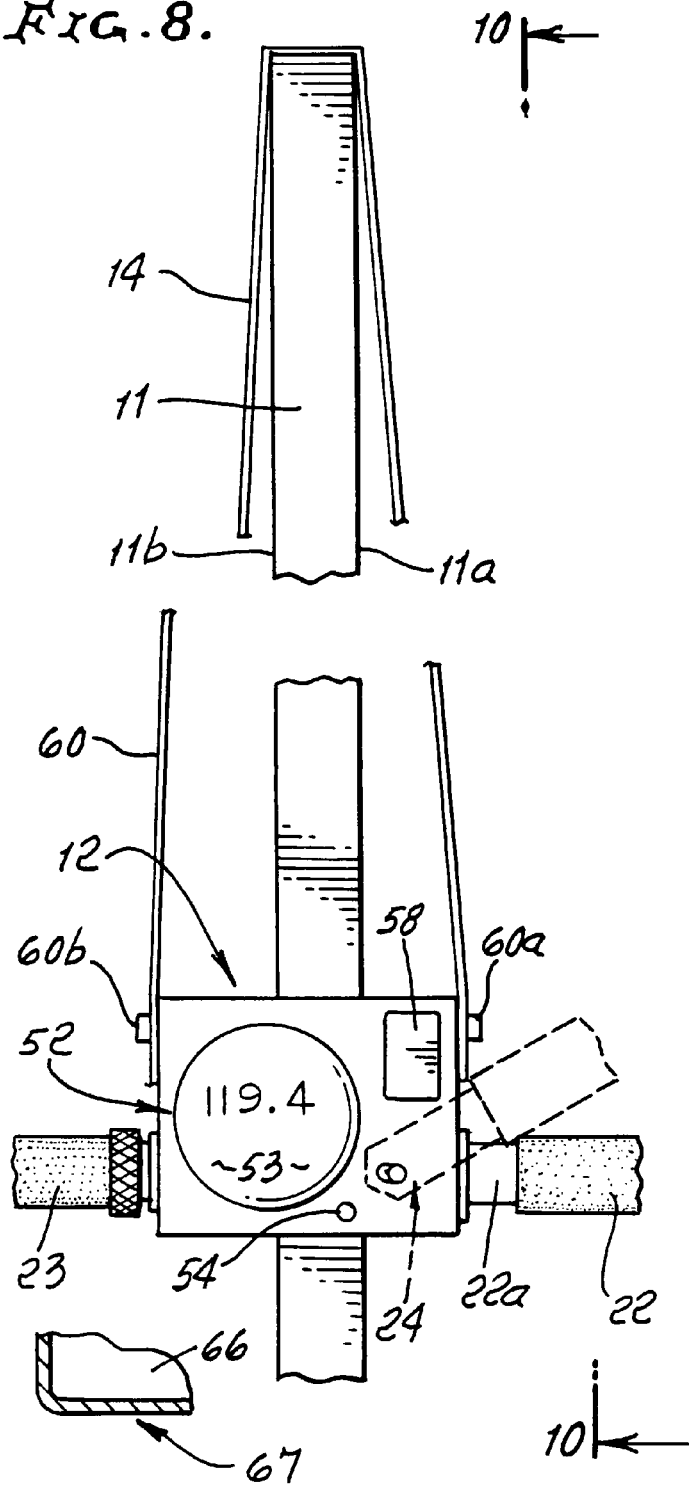
Figure 10:
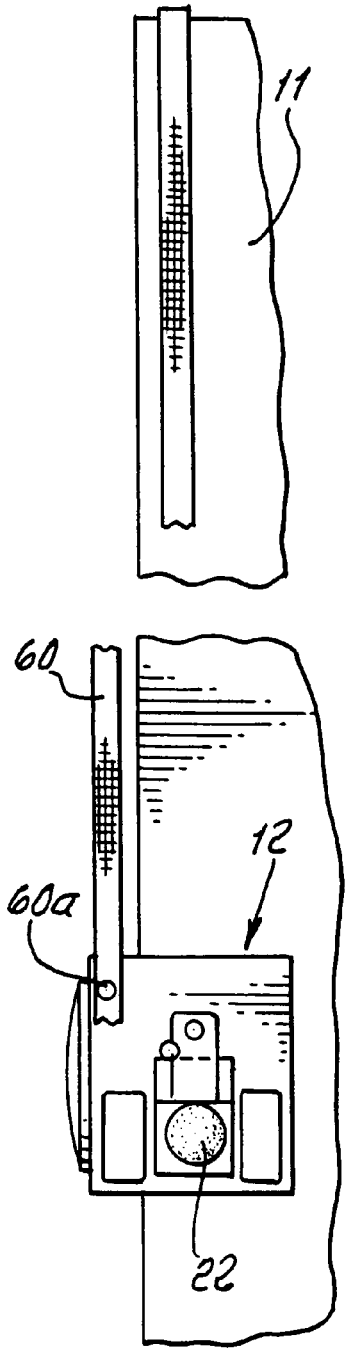
Figure 9:
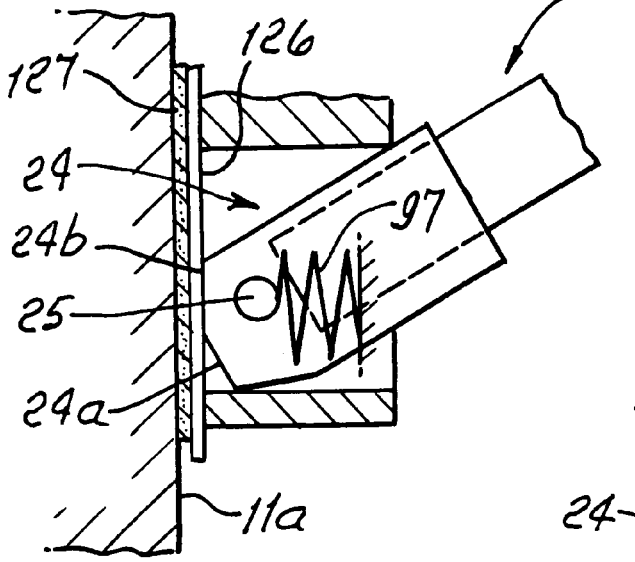
Figure 9A:
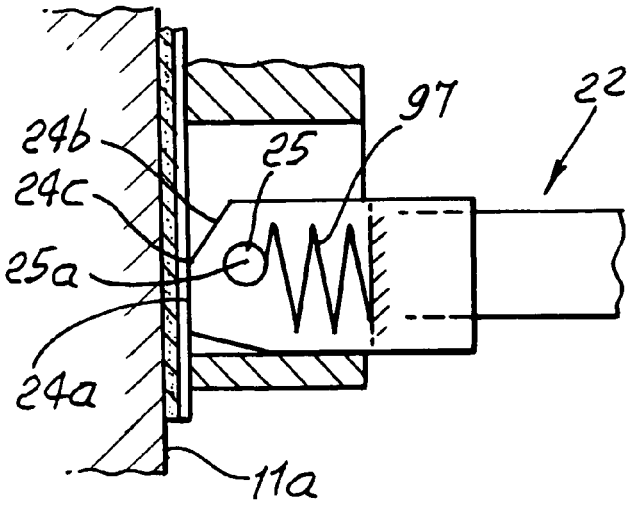

FIG. 3*a* is a section showing details of a tightener as is also shown in FIG. 3;

FIG. 4 is like FIG. 2, but also shows crotch protective means;

FIG. 5 is a perspective view of the apparatus applied to a door;

FIGS. 6 and 7 are perspective views showing use of the FIGS. 1-5 apparatus;

FIG. 8 is a frontal view of the apparatus showing details of construction;

FIG. 9 is a side view of a clamp element in initial position;

FIG. 9*a* is like FIG. 9, but shows the clamp element in clamping position;

FIG. 10 is a side view taken on lines 10-10 of FIG. 8; and

Figure 11:
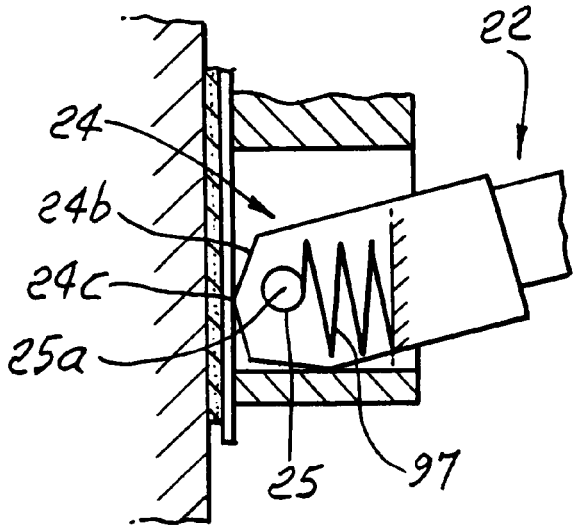

FIG. 11 is a schematic view showing an intermediate position of the clamp element.

DETAILED DESCRIPTION

In FIGS. 1-3, 8 and 9, the human body suspension apparatus 10 is configured for application to a door 11, and includes a support body 12 associated with a door clamp, typically carried by body 12. As seen in FIG. 3, the lightweight body is generally U-shaped, i.e. channel shaped, in horizontal cross section, to adjustably straddle a door edge portion 11*a* above the level of a door handle 14 and bolt 15. See body legs 12*a* and 12*b* extending at opposite sides of the door. A manually operable clamp device 13 is carried by the body, as for example by leg 12*a*, to be tightened and clamped to the door side 11*b*, and thereby tightens or pulls leg 12*b* against the opposite side 11*b* of the door. The tightening is sufficient to firmly clamp body 12 to the door, against loosening during suspension of user's body weight applied to body 12. A safety cord or ribbon 60 attached to body 12 at 60*a* may be employed to loop over the door top and hang at 14, as shown. It may be connected at 60*b* to the body. Vertically spaced annular grommets attached to the ribbon may selectively be fitted over a pin 60*c* on body 12 to adjust the height of the body on the door to suit hang positioning of the user.

Figure 1:
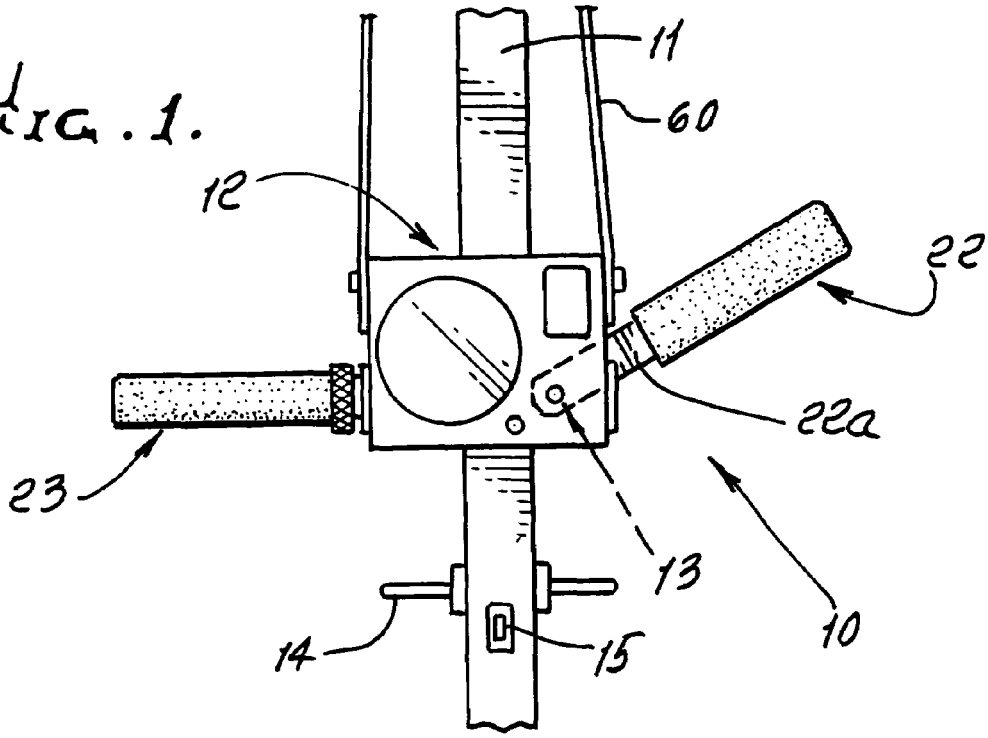
FIG. 1 is a front elevation showing preferred apparatus incorporating the invention.

FIG. 1 also shows hand grips or pins 22 and 23 projecting generally horizontally oppositely, as shown. Such pins or grips are to be grasped by the user as he or she suspends human body torso and leg weight, while human body legs straddle the door at its opposite sides. See for example FIGS. 6 and 7, showing the user's hands 30 grasping and hanging from the grip pins, and the user's legs 31 straddling the door as by their extension in generally L-shaped relation to the torso 32. The end of pin 23 fits into a bore 117 formed in tightener 118, as seen in FIG. 3*a*. The tightener is thread connected at 119 to body leg 12*b*, so that when protruding knurled flange 120 on 118 is rotated, the right end of 118 advances toward the door side 11*b*. A plate 120 is thereby advanced, without rotation, to the right to urge a non-metallic (leather, for example) pad or strip 121 against the left side 11*b* of the door.

Pins 22 and 23 are preferably removable from their connections 22*a* and 23*a*, for easy of transport or shipment of the apparatus, as in a container 66 of an easily transported kit 67, shown in FIG. 8, for set-up at any destination having a door.

Referring to FIGS. 9, 9*a* and 11, they show sequential positions of one grip 22, and associated clamp 24 between an initial up-position (FIG. 9) of clamp 24, an intermediate position of the clamp 24 (FIG. 11) as it is being rotated or pivoted downwardly and a full down position of the clamp (FIG. 9*a*) and grip 22 wherein the door is clamped with very high level, maximum force.

The clamp 24 is shown to have two relatively angled flat surfaces 24*a* and 24*b*, which intersect at nose 24*c*. Surface 24*b* is flatly presented toward the door in FIG. 9, wherein surface 24*a* is then angled away from the door in FIG. 9; surface 24*a* is flatly presented toward the door in high level force transmitting position in FIG. 9*a*, wherein surface 24*b* is then angled away from the door; and in FIG. 11 the nose 24*c* is presented in force transmitting intermediate position toward the door, wherein both surfaces 24*a* and 24*b* are at that time angled away from the door.

It will be noted that the clamp has an axis of rotation, provided by pivot 25, and indicated at 25*a*. That axis is shifted directionally away from the door, (against force exerted by spring 97—see below) as seen in FIG. 11 as the clamp is rotated downwardly, with nose 24*c* sliding upwardly against surface 126 to an "over center" position at a level slightly above the level of axis 25*a*; i.e., as over-center clamp rotation continues, axis 25*a* returns part way back toward surface 126, and angled surface 24*a* comes into engagement with surface 126. A pre-loaded, heavy duty spring 97 exerts force against the pivot to resist its rightward displacement as described, and to exert force acting to urge the clamp surface 24*a* against surface 126 in FIG. 9*a* stable position.

FIG. 10 shows the pin 22 in down, i.e. FIG. 9*a* position, and a latch 98 swung clockwise downwardly (see arrow 98*a*) to block upward manual displacement of the pin. The axis of swinging of the latch is indicated at 99. A stop 100 is sidewardly engaged by the latch to position it, as shown. When the latch is swung counterclockwise in release direction, the pin 22 and clamp 24 can then be swung upwardly about pivot axis 25*a* to FIG. 9 position, releasing the clamp. It will be noted that during such release, the nose 24*c* need only travel a slight distance downwardly to unstable position below the level of axis 25*a*, at which point, the compression of the spring 97 assists further upward swinging of pin 22, and release of the clamp.

The invention provides for 3 stages of exercise, each stage having 2 modes of exercise; static and dynamic, to progressively strengthen muscles and increase endurance, using the apparatus as referred to, and wherein:

Stage 1 includes: user 34 sitting on a base support 70 or on a cushion on that support, with legs extended to straddle the door; feet being on the ground or supported close to the ground; and grasping the pins to elevate, slightly, the torso, and then holding (Static Mode) for up to 2 minutes, and then lowering the torso to seated position. If not attaining 2 minutes in the first attempt, rest for no more than 60 seconds before continuing, repeating the process until either reaching an accumulated time, at elevation, of 2 minutes, or 5 repetitions, whichever comes first. The Dynamic Mode is performed exactly the same except, instead of holding at the elevated position, as many pull-ups as possible are attempted during the accumulated 2 minute time.

Stage 2 includes: same as Stage 1, except instead of both feet on the ground, one foot is lifted and held parallel to the ground during half of the accumulated 2 minutes and then the position of the feet are alternated for the balance of the 2 minutes.

Stage 3 includes: same as Stage 2, except instead of one foot lifted and held parallel to the ground, both feet are lifted at the same time and held parallel to the ground for the accumulated 2 minutes or 5 repetitions, whichever comes first. Timer 52 is used to time the durations of such steps. Timer 52, may be carried by the body for use by the human manually grasping said grips, and operating said timer to time the duration of said suspending of the torso. The timer is shown to include a display having a transparent window 53. A timer START-STOP button is shown at 54. A battery case is provided in 12, at 58. Example: the timer/accumulator display is typically a battery powered, 4 digit, 3 inch round micro-processor based module with a black activation button on its lower half, programmed specifically to aid during gym exercises. The timer counts to a tenth of a second, by pressing the black activation button. The timer will begin to count down from 10 seconds. Once reaching zero, the timer will begin to count up while at the same time the trainee will begin his/her first repetition. If the trainee cannot attain 2 minutes in the first repetition, immediately upon ending the first repetition, the trainee will press the black activation button which will freeze the accumulated time on the display. For the first 10 seconds, the display will alternate between the number of reps and the elapsed time that has been accumulated; after which, the timer will begin counting down from 50 seconds. Before the timer reaches zero, the trainee will have to press the black button, and continue on with the exercises, or the trainee's accumulated time will be lost, upon activation, time will pickup at the point from which it had been stopped. This routine can be repeated indefinitely; but, stopping at 5 reps, or once accumulating 120 seconds, whichever comes first, is suggested.

General notes: the timer will turn off: (1) once reaching 180 seconds, or (2) by pressing the black button during countdown, or (3) whenever the timer is counting up, and the black button is pressed and held for 3 seconds.

A crotch protector cushion 50 may be provided and applied to the door edge, and is seen in FIGS. 4 and 5. It may have U-shape in cross-section, and formed to sidewardly removably grip the door.

I claim:

1. The method of human body suspension, that includes:

a) providing an upright openable door having a vertical edge, and a support body including a clamp clamped to the door and at opposite sides of the door, said body extending adjacent the door edge, b) straddling the door at the door vertical edge by extending human legs generally transversely at opposite sides of the door, c) providing grips operatively connected to the support body to project outwardly at opposite sides of the door and generally perpendicular to the support body, wherein one grip is pivotally supported by the support body to control clamping, d) and manually grasping the grips to exert force acting to suspend the human torso and legs which remain straddling the door and extending transversely during said suspending of the torso and legs, e) and at the same time one of the following exists:

i) user's feet and legs are in a rest position relative to the door, ii) user's legs are lifted relative to the door, iii) user's legs are lifted to a raised position relative to the door, and user holds his position as long as he can.

2. The method of claim 1 which includes lowering and elevating the human torso and legs, during said suspending and then repeating said lowering and elevating, to strengthen muscles of the human arms, torso and legs.

3. The method of claim 1 which includes clamping said support body to the door at selected elevation.

4. The method of claim 3 including providing a door clamp pivotally carried by the body, one of the grips operatively connected to the clamp to pivot the clamp thereby to progressively press connect to the door as said one grip is manually pulled downwardly relative to the body and door and allowing body weight to urge said one grip downwardly to increasingly clamp the door.

5. The method of claim 1 wherein the torso and legs remain in generally L-shaped configuration during each of said ii) and iii) leg lifted steps.

6. The method of claim 3 wherein the torso and legs remain in generally L-shaped configuration.

7. The method of claim 4 wherein protective material is positioned against the door and press connected thereto as the clamp is pivoted.

8. The method of claim 4 including providing door surface protection means associated with the support body or the clamp to engage the door surface during said clamping.

9. The method of claim 1 including providing a timer carried by said body for use by the human manually grasping said grips, and operating said timer to both time the duration of each said ii) and iii) steps suspending of the legs, and the accumulated time for the number of repetitions attempted, the timer operated to time two minute intervals for each said ii) and iii) leg lifting steps.

10. The method of claim 1 including providing and attaching a crotch protector to the door below the level of said support body.

11. The method of claim 1 including providing an elongated safety ribbon attached to the support body and extended over the top of the door.

12. The method of claim 1 including using said grips and door for holding the torso at an elevated position, for about two minutes, during each said steps ii and iii).

13. The method of claim 12 wherein the legs are also elevated, and held in said elevated position, for as long as possible.

14. The method of claim 12 wherein the legs and torso are held in generally L-shaped configuration while the torso is held in said elevated position.

15. The method of claim 11 including providing selective connections on the ribbon to be connected to the support body.

16. Apparatus for enabling human body suspending, comprising in combination a) a support body including a clamp and configured for clamping to an upright openable door, the clamp configured to extend adjacent the door edge, b) two substantially identical grips operatively connected to the body to project outwardly at opposite sides of a vertical plane defined by the door and generally perpendicular to the support body, to be manually grasped to receive lifting force exertion acting to suspend the human torso while the human legs remain straddling the door during said suspending of the torso and legs, only one grip pivotally supported to pivot up and down to control clamping, c) a safety ribbon attached to the support body and extended over the top of the door, d) a crotch protector cushion attached to the door below the level of said support body.

17. The apparatus of claim 16 in combination with said door, and including a timer carried by said body, for timing of the duration of each said suspending, and the accumulated time for the number of repetitions attempted, the timer configured to time two minute intervals for leg lifting steps.

18. The apparatus of claim 17 including said door having an edge portion, and said clamp acting to clamp the support body directly to said door edge portion.

19. The apparatus of claim 16 wherein the door clamp is pivotally carried by the body, said one of the grips operatively connected to the clamp to pivot the clamp thereby to progressively press connect to the door vertical side or sides as said one grip is manually pulled downwardly relative to the body and door.

20. The apparatus of claim 16 including door surface protection to protectively engage the door surface as clamping force is transmitted thereto during said clamping.

21. The apparatus of claim 19 wherein said clamp has angled surfaces variably presented toward the door side or sides as the clamp is rotated by a grip.

22. The apparatus of claim 21 wherein the clamp has an axis of rotation that is shifted first away from the door and then toward the door as the clamp is rotated downwardly to move one of said angled surfaces away from the door and to urge the other of said surfaces toward the door to exert door clamping force.

23. The combination of claim 22 including a latch shiftable into and out of a position wherein the clamp is held in a down position in which said clamp other surface exerts door clamping force.

24. The combination of claim 22 wherein a clamp pivot defines said axis of rotation, and including spring means carried to yieldably urge said pivot toward the door.

25. The combination of claim 22 wherein said angled surfaces include over center clamping surfaces associated with one of the grips, and configured to successively transmit clamping force to the door during said downward pivoting of the one grip, and wherein maximum clamping force is transmitted to the door in downwardmost pivoted position of said one grip.

26. The combination of claim 21 wherein said angled surfaces are carried for yieldable translation relative to the door as said one grip is pivoted downwardly, there being spring means located to be variably tensioned in response to said downward pivoting.

27. Apparatus for enabling human body suspending, comprising in combination a) a support body including a clamp and configured for clamping to an upright door, b) grips operatively connected so as to be generally perpendicular to the body to project outwardly at opposite sides of a plane defined by the door, to be manually grasped to receive lifting force exertion acting to suspend the human torso while the human legs remain straddling the door during said suspending of the torso and legs, c) the door clamp being pivotally carried by the body, said one of the grips operatively connected to the clamp to pivot the clamp thereby to progressively press connect to the door vertical side or sides as said one grip is manually pulled downwardly relative to the body and door, d) the clamp having angled surfaces variably presented toward the door side or sides as the clamp is rotated by a grip, e) said angled surfaces being carried for yieldable translation relative to the door as said one grip is pivoted downwardly, there being spring means located to be variably tensioned in response to said downward pivoting, f) and including a metallic plate engaged by said clamping surfaces and a non-metallic protective material associated with the plate and positioned to transmit clamping force to the door.

* * * * *